US006651365B1

(12) United States Patent
Wainwright

(10) Patent No.: US 6,651,365 B1
(45) **Date of Patent: *Nov. 25, 2003**

(54) ARTICLES WITH ILLUMINATED SEQUENCED MOTIONED DISPLAYS

(75) Inventor: Harry L. Wainwright, Bethlehem, PA (US)

(73) Assignee: ANI-Motion, Inc., Bethlehem, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/870,601

(22) Filed: Jun. 6, 1997

Related U.S. Application Data

(63) Continuation of application No. 08/450,789, filed on May 26, 1995, now abandoned.

(51) Int. Cl.[7] ..... G09F 13/02

(52) U.S. Cl. ..... 40/452; 40/442; 362/32; 362/806

(58) Field of Search ..... 40/442, 452, 547, 40/550; 362/32, 103, 806

(56) References Cited

U.S. PATENT DOCUMENTS

| | | | | |
|---|---|---|---|---|
| 1,132,823 A | * | 3/1915 | Bambeck | 40/442 |
| 1,346,493 A | * | 7/1920 | Hammond et al. | 40/452 X |
| 2,006,436 A | * | 7/1935 | Bowers | 40/442 X |
| 3,184,872 A | | 5/1965 | Way | |
| 3,549,878 A | | 12/1970 | Bailey | |
| 3,688,008 A | * | 8/1972 | Krieger, Sr. | 40/442 X |
| 3,715,822 A | * | 2/1973 | Hansen, Jr. et al. | 40/442 |
| 4,110,818 A | | 8/1978 | Hempsey | |
| 4,164,008 A | | 8/1979 | Miller et al. | |
| 4,234,907 A | | 11/1980 | Daniel | |
| 4,480,293 A | | 10/1984 | Wells | |
| 4,570,206 A | | 2/1986 | Deutsch | |
| 4,602,191 A | | 7/1986 | Davila | |
| 4,727,603 A | | 3/1988 | Howard | |
| 4,747,648 A | * | 5/1988 | Gilliland, III | 40/547 X |
| 4,875,144 A | | 10/1989 | Wainwright | |
| 5,559,681 A | * | 9/1996 | Duarte | 362/252 |
| 5,575,554 A | * | 11/1996 | Guritz | 362/103 |

FOREIGN PATENT DOCUMENTS

| | | | | |
|---|---|---|---|---|
| DE | 2835197 | * | 4/1979 | 40/452 |
| FR | 0155157 | | 9/1985 | |

* cited by examiner

*Primary Examiner*—Brian K. Green
(74) *Attorney, Agent, or Firm*—Sanford J Piltch

(57) ABSTRACT

Apparatus for producing a continuous animated display of one or more images within a single display frame space utilizing sequenced illumination patterns or arrays of groups of optical fibers for illuminating each of a plurality of sub-frame images in a pre-programmed, timed sequence to achieve one or more animation techniques imparting continuous animated motion to the one or more images for producing the desired animated motion on a planar surface.

9 Claims, 9 Drawing Sheets

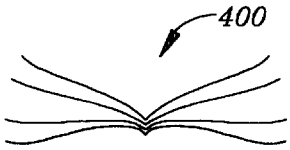
Fig. 4
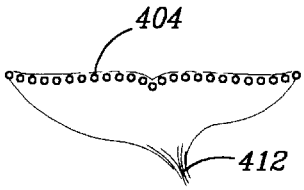
Fig. 4B
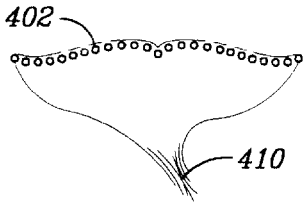
Fig. 4A
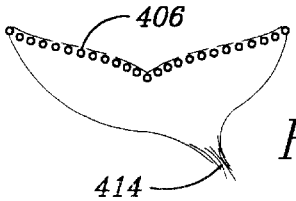
Fig. 4C
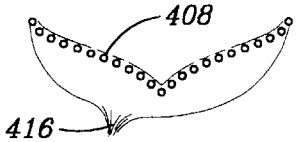
Fig. 4D
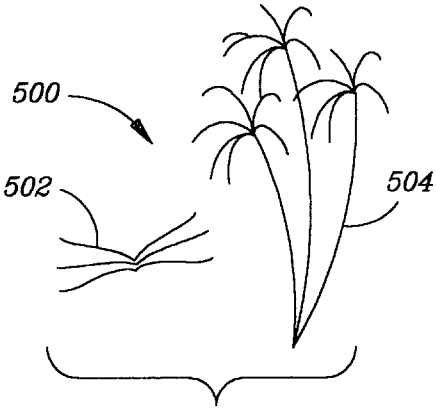
Fig. 5
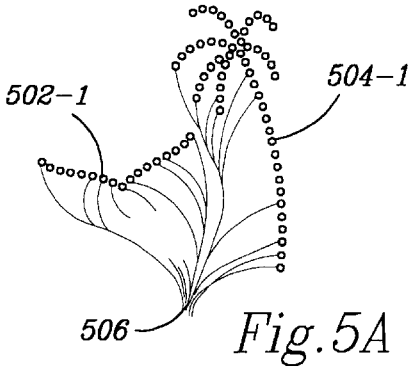
Fig. 5A
Fig. 5B
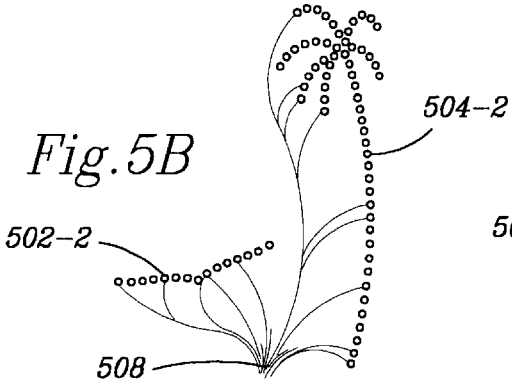
Fig. 5C
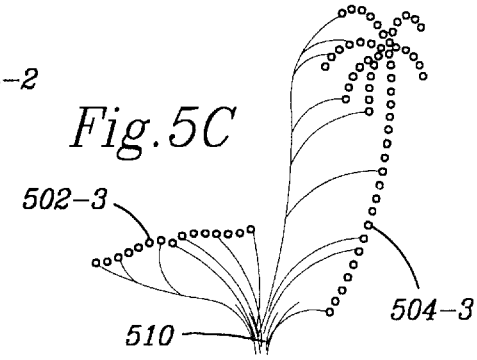

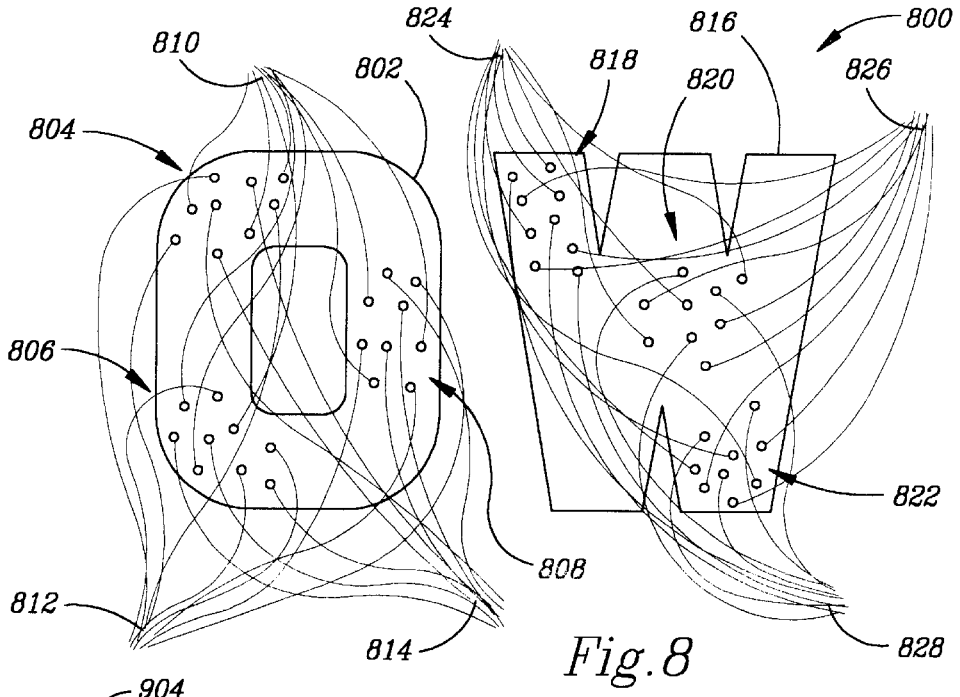
Fig. 8
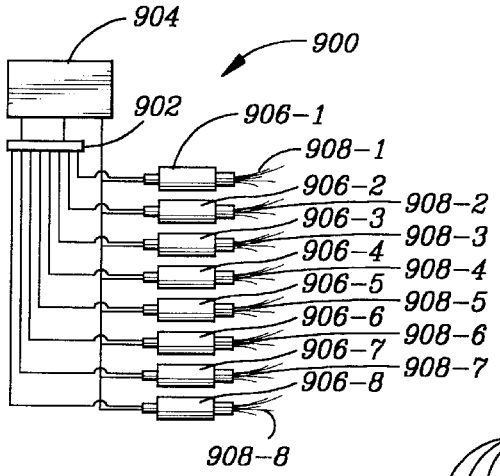
Fig. 9
Fig. 10
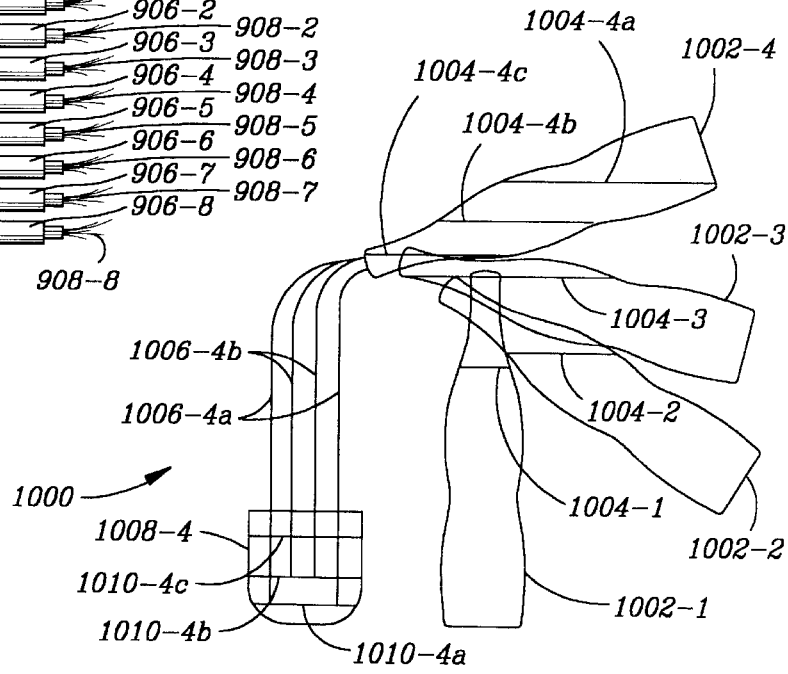

ARTICLES WITH ILLUMINATED SEQUENCED MOTIONED DISPLAYS

CROSS-REFERENCE TO RELATED APPLICATION

This application is a continuation of U.S. patent application Ser. No. 08450,789, filed May 26, 1995, now abandoned.

BACKGROUND OF THE INVENTION

This invention relates to articles which contain illuminated sequenced motion displays and, more particularly, to the appropriately sequenced illuminated segments of a plurality of segments of an entire display to simulate motion, or display animation. The preferred environment for the carrying or mounting of the animated illuminated displays are articles of clothing and rigid display boards which may be used in advertising point of sale goods.

There have been many prior attempts at providing sequential motion or animation to an illuminated display, some of those have been found to utilize articles of clothing. One manner of providing illumination to an article of clothing is by using light emitting diodes connected to an underlying rigid printed circuit board mounted either to the interior of the clothing article, or between the inner and outer surfaces of the clothing article, with the light emitting end of the diode projecting through the garment to the outside surface to be viewed when illuminated. The various U.S. Patents which fall into this category are U.S. Pat. No. 4,164,008 [Miller, et al.], U.S. Pat. No. 4,480,290 [Wells], U.S. Pat. No. 4,570,206 [Deutsch] and U.S. Pat. No. 4,602,191 [Davila].

Another type of illumination of an article of clothing is described in U.S. Pat. No. 3,549,878 [Bailey] which discloses the use of bundles of optical fibers secured to selected outer portions of a garment. Individual fiber ends are turned outwardly from the bundles and project through the garment surrounding the bundle and are illuminated by a light source to create a changing color in a fixed pattern.

A light emitting fabric is disclosed in U.S. Pat. No. 4,234,907 [Daniel] which describes the use of optical fibers woven into and forming a portion of the fabric replacing some of the threaded fibers in the fabric. The goal of the optical fibers in Daniel is to uniformly illuminate the fabric of useful clothing articles, such as costumes, high visibility safety clothing, etc. The description of the illumination method is similar to that described above in connection with other articles of clothing with the exception that in this case the fairly long lengths of optical fibers are scratched or abraded along their outer surfaces so that light is emitted along the length of the fiber and not only at its end.

Another article of clothing containing light conducting fibers is disclosed in U.S. Pat. No. 4,727,603 [Howard] which describes the decoration of the outer surface of the article of clothing where segments of light conducting fibers are stitched onto the outer surface of the clothing forming a decorative pattern. The light conducting fibers are then modified by heating the ends of the fiber segment to produce an enlarged bead or bulbous head and by abrading the longitudinal surface of the lengths of fiber to form regular or random pattern recesses which will emit light along the entire length of the fiber.

U.S. Pat. No. 4,110,818 [Hempsey] discloses the illumination of a flag or pennant using optical fibers to form an illuminated message. U.S. Pat. No. 5,288,259 [Konta, et al.] discloses a toy doll or animal with simulated hair having at least some of the hair fibers formed of optical fiber for illumination of those fibers by a light source within the doll.

More recent disclosures concerning articles of clothing which are illuminated are found in U.S. Pat. No. 5,177,812 [DeMars] and 5,128,843 [Guritz]. The DeMars patent discloses an elongated light tube which can be illuminated for mounting within a groove formed in the wearing apparel and snugly retained in the groove to be illuminated to display a particular fixed shape. The patent to Guritz discloses an optical display device mounted within an article of clothing to enhance body motion, such as the upper body limbs, to enhance the optical display through the motion of the body for ornamental purposes, or for the purpose of providing greater safety to the wearer. The Guritz device uses flexible strip circuit boards, rather than rigid circuit boards, which are used to illuminate a series of incandescent lamps.

Additionally, and particularly with regard to more rigid display apparatus, a moving pattern simulator is disclosed in U.S. Pat. No. 3,184,872 [Way]. A display board is provided with a series of perforations at pre-determined locations to receive the ends of a plurality of light conducting fibers. The opposite ends of the individual fibers are bundled within a support member to be arranged in a particular predetermined spatial relationship so that upon illumination the desired movement of the light pattern appears on the face of the board. A light source spaced apart from the support member is utilized to illuminate the optical fibers by passing light through an opaque disk having a plurality of particularly sized and shaped openings in the disk. As the opaque disk rotates the openings provide a conductive path for the radiated light between the light source and the ends of the optical fibers to sequentially illuminate the viewed ends of the optical fiber bundle in a sequentially pre-selected pattern.

European patent application Publication 01 551 578A2 [French] discloses a decorative floor covering, such as a carpet, which has threaded through it a number of optical fibers which extend to the same height as the carpet fibers. The optical fibers extend in bundles to a light source which, through the means of various colored filters, provide different colored light to the optical fibers, which light is displayed on the surface of the carpet.

Finally, U.S. Pat. No. 4,875,144 [Wainwright], an earlier patent of the same inventor as the present invention, discloses a fabric (preferably formed into an article of clothing) having an illuminated changing display utilizing optical fibers to provide illumination to segments of a changing display. The optical fibers extend along the inner surface of the fabric, are gathered into several pre-selected groupings or bundles, each of which bundle having a connection to a light source which is controlled for illumination of the segments of the design of the display in a select ed sequence.

Although some of the previously disclosed illumination of garments and fixed displays utilize optical fibers, light emitting diodes, incandescent lamps, etc., which protrude through the fabric, generally provide only a fixed display when illuminated. The exception to these illuminated fixed displays are the inventions disclosed in the patents to Way, Wells, Davila and Wainwright. However, all of these patents suffer from the limitation of providing for sequential illumination of periodic but separate displays which, when taken in combination, depict disjointed motion. In the case of Wainwright, the sequenced illumination of the segments of the optical fiber bundles depict an enlarging growth pattern of a flowering plant, but without a continuity of motion which creates an animated illuminated pattern. Further, most of the earlier devices utilize rigid circuit boards or mounting methods which create an unwanted bulkiness and rigidity to at least a portion of the article of clothing which is entirely undesirable especially when using lightweight fabrics and totally undesirable for display panels with limited depth dimensions. Also, optical fibers which are woven into a fabric and which are dependent upon abrasions in their outer surfaces for illumination are impractical for the reason that they create random lighting patterns rather than the desired pattern for producing the-sequenced motion for continuous animation.

It is, therefore, an object of the present invention to provide continuously animated pin-point illuminated displays for wearing apparel and display articles.

It is also an object of the present invention to provide such enhanced illuminated continuous animation to be equally observable in either daylight or brightly lighted rooms or after dark or in rooms having very low light levels.

Another object of the invention is to provide a system for continuing animation of display images on articles of clothing and on display articles without noticeable bulges or significant space requirements due to wire bundles, bulbs or rigid circuit boards.

It is a further object of the invention to provide detachable control modules that, when removed, allow the article of clothing or display article to be easily washed or cleaned, eliminating the potential for fabric or paper destruction around empty socket holes and the like when earlier illumination systems were entirely removed from their display positions.

Yet another object of the invention is to provide electronic control modules which produce the pre-determined sequential motion providing an observable animation of the displayed scene, which control appropriately sequences the timing of the illumination of display segments, luminescence of the display segments, and for the continuous repetition of the animated sequence of the display.

Other objects will appear hereinafter.

SUMMARY OF THE INVENTION

The present invention provides for the combination of a variety of illumination techniques to derive animated motion across a single frame by utilizing timed sequencing of bundles of optical fibers arrayed in specific patterns to produce a plurality of sub-frame images on a planar surface. The various illumination techniques may be described as linear continuous segment, either separate or overlaid, repetitive directional reversing, rotational, and marquee or starburst random which are utilized to define instantaneous image positions producing the desired visual perception of animation or image motion within a single defined area. The present invention by utilizing timed sequence illumination of sub-frame images or array patterns of the display ends of optical fibers will produce the desired visual perception of the instantaneous image defined by the illumination of the array or pattern of optical fiber ends such that motion will be imparted across the defined area of the planar surface to produce the animation of the overall, combined image. It is contemplated by the present invention, in order to make the motion easier to perceive, and to augment the animation, to use a variety of different colors as well as the combination of several different techniques of depicting motion to achieve the desired animated unified movement of the image.

The present invention can be described as an apparatus for producing a continuous animated display of one or more images within a defined area utilizing a changing illuminated pattern of groups of optical fibers. The apparatus may be comprised of a plurality of fiber optic bundles with each bundle containing one or more groups of optical fibers having a first end for receiving illumination and a second end for displaying the illumination across the defined area. The apparatus will also be comprised of a plurality of light sources arranged in juxtaposition against a corresponding number of fiber optic bundles for providing the illumination to the receiving ends of each of the optical fibers. The application of the illumination to the receiving ends of the optical fibers will cause the display ends of one or more groups of the optical fibers, which are mounted to and through a planar surface in a plurality of pre-determined patterns or arrays for creating a plurality of sub-frame images on the planar surface within the defined area. To provide the timed sequence of illumination, a control circuit is provided for illuminating each of the plurality of pre-determined arrays or patterns so that each of the plurality of sub-frame images is illuminated in a pre-programmed timed sequence so that a combined continuous animated motion of one or more images is produced. In this manner, the plurality of sub-frame images are combined to form the combined continuous animated display within the defined area on the planar surface.

The planar surface may be a flexible fabric material such as is used in wearing apparel or be a flexible plastic, polymeric, cardboard or other paper material utilized in constructing substantially rigid display panels. It is also contemplated by the invention that the control circuit comprises switching means for connecting one or more sources of energy to provide sufficient energy to illuminate the plurality of light sources. The control circuit means also contains pre-program means for controlling the timing and sequence of the illumination to the plurality of fiber optic bundles by utilizing the switching means to energize the plurality of corresponding light sources.

It is further contemplated by the present invention that the plurality of sub-frame images may be combined by overlaying such sub-frame images to achieve the combined continuous animated motion of one or more images displayed in the defined area. Such overlaid combination of sub-frame images may produce rotational motion or repetitive directional reversing motion. Further, the plurality of sub-frame images may be combined in a successive linear progression to achieve the combined continuous animated motion of the one or more images across the defined area of the planar surface. Such successive linear progression of sub-frame images may produce motion which will impart image expansion or contraction, segmented directional flow, direction reversing or random sparkling motions. The pre-program timing sequence of the control means may also permit the overlapping of illumination of a plurality of sub-frame images utilizing the successive linear progression illumination technique to achieve the desired motion. It is further contemplated that a means for coloring the plurality of light source s for illuminating the plurality of sub-frame images in different colors is utilized to achieve the visually perceptive animated motion. Further, the present invention contemplates providing means for illuminating the plurality of sub-frame images to achieve a combined, unified, continuous animated motion of the one or more images arrayed across the defined area on the planar surface.

BRIEF DESCRIPTION OF THE DRAWINGS

For the purpose of illustrating the invention, there is shown in the drawings forms which are presently preferred;

it being understood, however, that the invention is not limited to the precise arrangements and instrumentalities shown.

FIG. 4 is a single frame repetitive back and forth sequential animation of a bird in flight.

FIGS. 4A–4D depict each of four separate sequential points of illumination overlaid to form the animated motion of FIG. 4.

FIG. 5 is a single frame multiple segment forward and reverse sequential animation of a bird in flight and swaying palm tree incorporating multiple color illumination points within the single frame.

FIGS. 5A–5C depict each of three separate segments which are overlaid to form the animated motion of FIG. 5.

FIG. 8 is a series of randomly grouped illumination points of letter characters "O" and "W" which produce a chaotic or random sequence of illumination of each of the characters within their respective borders.

FIG. 9 is a functional block diagram of the control module and interface to the light sources and fiber optic bundles for providing the sequenced illumination in accordance with the various embodiments (in the form of continuous animated motion) of the present invention.

FIG. 10 is a single frame utilizing a combination of various animation techniques of the present invention having separate frame segments which are joined by another segment producing the sequential animated motion.

DETAILED DESCRIPTION OF THE PREFERRED EMBODIMENT

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
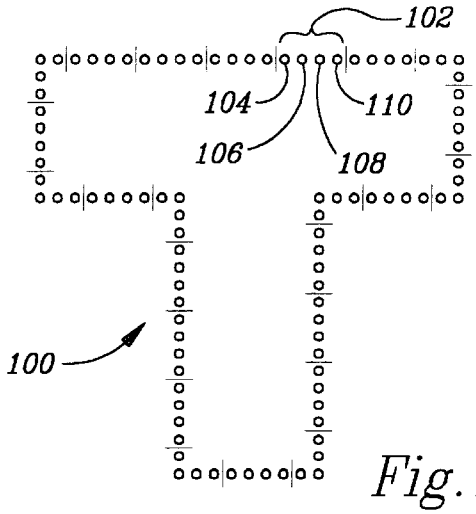
FIG. 1 is a single frame chase sequence of points of illumination formed as a letter "IT")

Referring now to the drawings in detail, where like numerals refer to like parts or elements, there is shown in FIG. 1 a single frame display with a series of illumination points formed in the shape of a letter "T". A series of illumination points following the outline of the letter "T" are divided into groups comprising four (4) illumination points. The single frame letter character "T" 100 is a simple form of light motion or illuminated animation which is commonly referred to as a "chase sequence". The single frame image of the letter character "T" 100 is divided into a series of groupings of illumination points 102 which represent the second or display end of a single optical fiber arranged along the outline of the letter character "T". In this example, the group of illumination points 102 is comprised of four (4) illumination points or fiber optic cable ends 104, 106, 108, 110. Each of the groupings 102 is repeated along the outline of the letter character "T" 100 so that the points of illumination in the groupings 102 are connected head to tail.

Figure 1A:
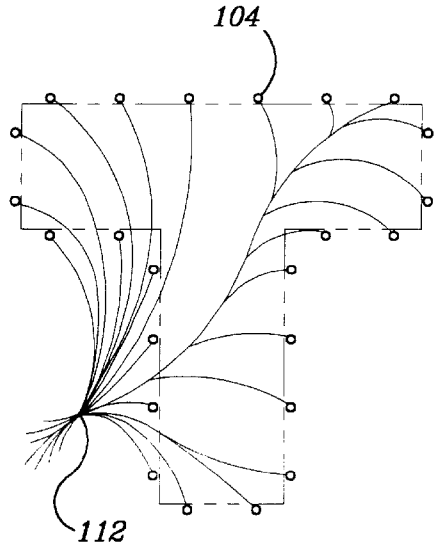
FIGS. 1A–1D depict each of four separate illumination sequences of the single frame chase sequence of the letter "T" of FIG. 1.
Figure 1B:
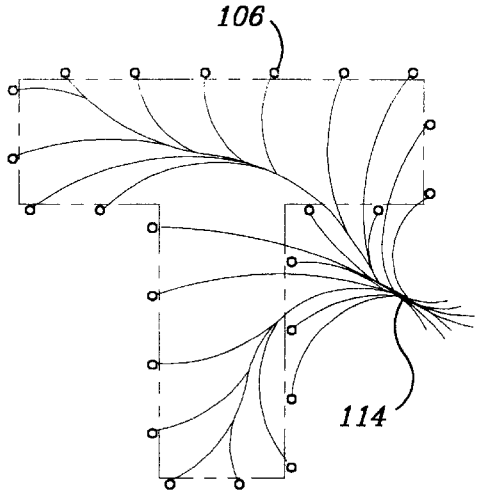
Figure 1C:
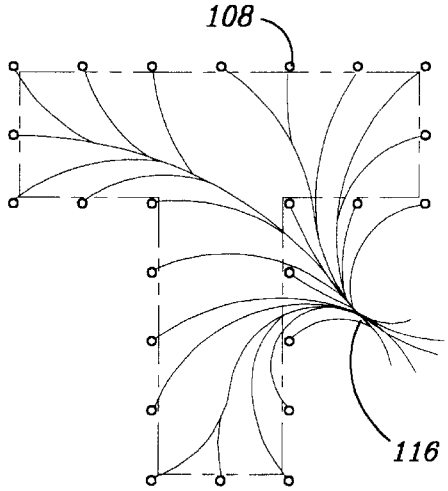
Figure 1D:
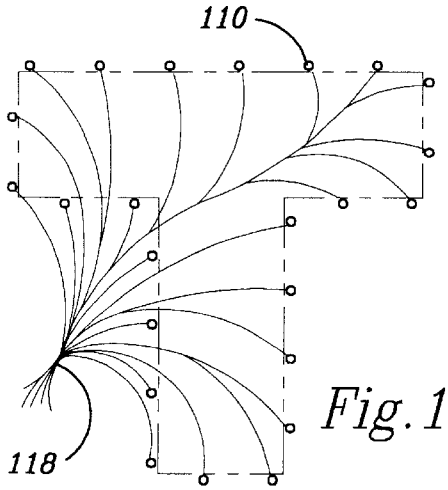

With reference to FIGS. 1A–1D, there is shown the bundling of optical fibers which form each of the four (4) segments of the groupings of illuminated points 102. FIG. 1A depicts the fiber optic bundle 112 and FIG. 1B depicts the second fiber optic bundle 114. Likewise, FIG. 1C depicts the third fiber optic bundle 116 and FIG. 1D depicts the fourth fiber optic bundle 118. The first through fourth fiber optic bundles correspond to the first through fourth frame segments, respectively, which cooperate to produce the illuminated chase sequence animation in the single frame illuminated image of the letter character "T".

Each of the four frame segments are depicted in each of the FIGS. 1A–ID by referencing the grouping of optical fiber ends 104, 106, 108 and 110 to identify and indicate the segments positioned in the chase sequence. Thus, the first optical fiber display end 104 (and the other optical fiber display ends in the first fiber optic bundle 112) comprise the points of illumination in the first frame segment of the chase sequence animation. The optic fiber display end 106 in FIG. 1B shows the second segment illumination, shifting to the immediate position to the right in group 102, along with the other optical fiber display ends in the second fiber optic bundle 114. Further, third optic fiber display end 108 indicates the position of the points of illumination in the third segment along with the other optic fiber display ends in the third fiber optic bundle 116. The fourth optic fiber display end 110 in FIG. ID shows the final position in the chase sequence of the fourth frame segment within the groupings 102, along with the other optic fiber display ends in the fourth optic fiber bundle 118.

To produce the "chase sequence", the first fiber optic bundle 112 is illuminated for a timed period such that a first end of the first fiber optic bundle 112 is illuminated which will transmit light to the second end of the optical fiber in the group 104. At the end of a timed period, illumination is removed from the first fiber optic bundle 112 and illumination is provided to a first end of the second fiber optic bundle 114. This shifts the points of illumination in the group 102 one space to the right (in the example grouping shown in FIG. 1) for a second timed period identical in length to the first timed period. The illumination source is then removed from the second fiber optic bundle 114 and a first end of the third fiber optic bundle 116 is illuminated for a third timed period of like length. This moves the points of illumination one additional space to the right as shown in the example grouping 102 in FIG. 1 when the second ends of the third set of optic fibers 108 of the third fiber optic bundle 116 are illuminated. To complete the sequence, illumination is removed from the third fiber optic bundle 116 and a first end of the fourth fiber optic bundle 118 is illuminated. This again moves the illumination one point to the right (as shown in the sample grouping 102 in FIG. 1) and illuminates the second end of the fourth set of optic fibers 110 and its companion optic fiber ends in the fourth fiber optic bundle 118.

In this manner, the sequenced application of a light source to a first end of the fiber optic bundles 112, 114, 116 and 118 causes the emission of light from the second display end of the optic fibers which comprise the fiber optic bundles 112, 114, 116 and 118. The second display end of the optic fibers 104, 106, 108 and 110, which are placed along the outline of the letter character "T" 100 to define the character emit the light in a sequence which is perceived as a motion moving from left to right (in the specimen grouping of FIG. 1) so that the light continuously moves ahead of its immediately previous position. This animation, caused by the continuous sequence of the illumination of plural groups of illumination points, as 102, produces an animation in a linear sequence of each subgroup 104, 106, 108 and 110. This linear sequence animation is utilized to define and depict, for example, pouring liquids, tires in motion, laser blasts, rain and the like.

Figure 2:
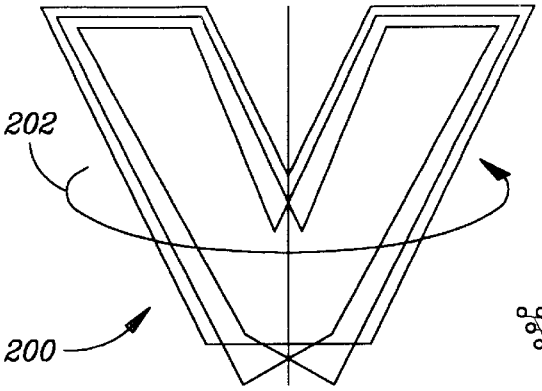
FIG. 2 is a single frame segment-by-segment forward sequence animation of a single letter character formed as a letter "V".

With reference to FIG. 2, there is shown a single frame segment-by-segment forward sequential animation of a single letter character formed in the shape of a letter "V". The image of the letter character "V" 200 has a series of segments which, when appropriately illuminated in sequence, produce a revolving or rotating of the letter character "V" 200 in the direction indicated by arrow 202. In order to accomplish the forward sequential motion in the direction of arrow 202, a series of frame segments with groups of illuminated points are necessary to achieve the motion perceived by a viewer.

Figure 2A:
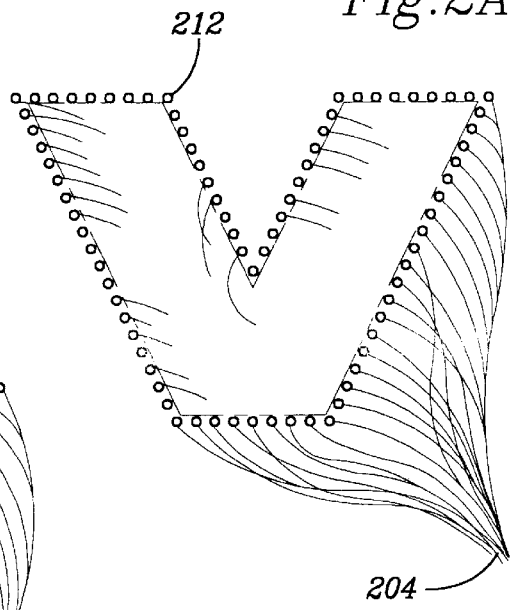
FIGS. 2A–2D depict each of four separate illumination sequences which are overlaid to form the continuous animation of the revolving of the letter "V" of FIG. 2.
Figure 2B:
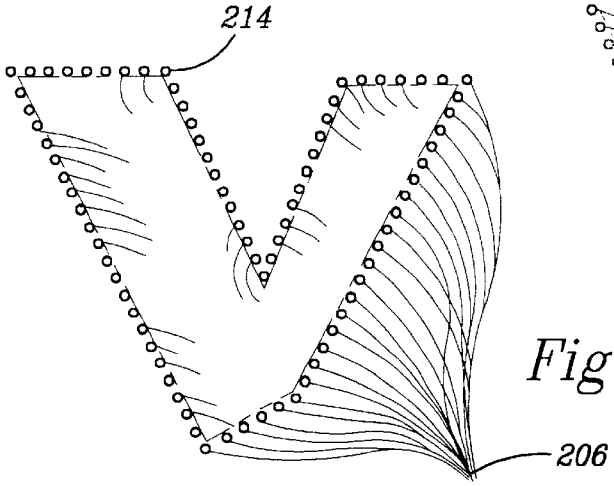

With reference to FIGS. 2A–2D, the series of frame segments and associated illuminated points and fiber optic bundles can be described. In the full face image of the letter character "v" 200, the first fiber optic bundle 204 is utilized to provide the first frame segment of the image "V" 200 by illuminating the group of optical fiber display ends 212. FIG. 2B shows the second in the series of frame segments depicting the letter character "V" 200 rotated slightly counter-clockwise about a vertical axis passing through its center. In this case, a second fiber optic bundle 206 is used to illuminate a second group of optical fiber display ends 214. The frame segment of the image shown in FIG. 2B is attempting a perspective view of letter "V" 200 to show the slight rotation about the central axis in the range of 30° to 60° from full face image.

Figure 2C:
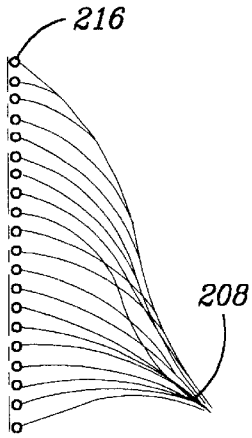
Figure 2D:
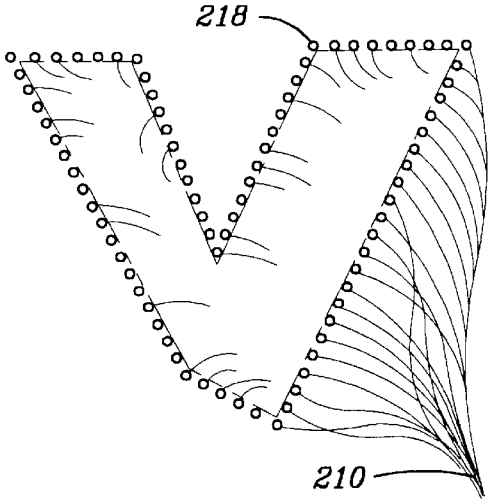

FIG. 2C shows the third frame segment in the series which depicts the letter character "V" 200 turned 90° from the full face image of FIG. 2A. In this case, the third fiber optic bundle 208 is utilized to illuminate the group of illumination points which can be generally described as the third group of optic fiber display ends 216. In the fourth segment of the rotating image of FIG. 2, FIG. 2D shows a different perspective view of the rotating or revolving letter character "VI" 200 which has now rotated to a position between 90° and 180° from its original position. A fourth fiber optic bundle 210 is used to illuminate the series of illumination points along the outline of the letter character "VI" 200 by illuminating the fourth group of optic fiber display ends 218 with rotation being in the range of 120° to 150° from starting position.

For a segment-by-segment forward sequential animation, two or more bundles of optical fibers are required. The example depicted in FIGS. 2 and 2A–2D shows four frame segments of a rotational sequential animation. As in all cases in illuminating optical fibers, the fibers are bundled at a first end and placed in close proximity to a light source and are dispersed at a second or display end, as in the case of the letter character "V" 200, along the outline of the various frame segment images of that character for each of the four (4) segments. The sequence of the segment by-segment forward animation begins with the image segment of FIG. 2A, continues with the partially rotated image segment of FIG. 2B, continues with the 90° rotated image segment of FIG. 2C, continues again with the more than 90° rotated image of FIG. 2D, and then with a one-half rotation (180°) with the first image segment of FIG. 2A. For a complete revolution, the four image segments are repeated a second time.

Using the frame segment by frame segment forward sequential animation technique occupying the same approximate area, FIGS. or shapes may appear to rotate or move in three-dimension across a flat or planar surface, e.g. moving or rotating balls, flying birds, etc., by positioning each sequential frame segment at a distance spaced apart from the immediately prior frame segment rather than overlaying each frame segment in the same space as was done in FIGS. 2 and 2A–2D.

Figure 3:
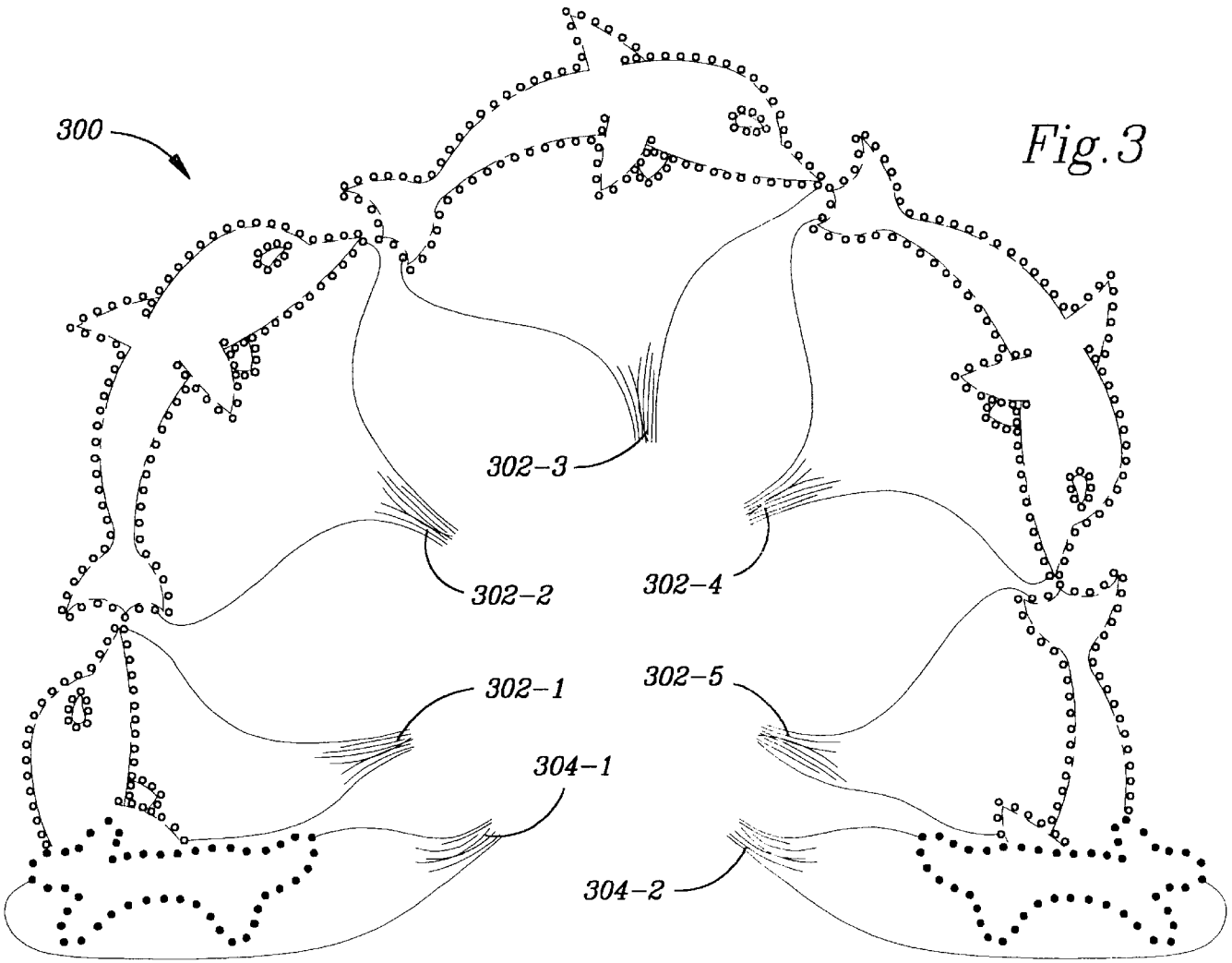
FIG. 3 is a single frame multiple segment sequential animation of a jumping dolphin with plural optical fiber bundles defining a single segment.

FIG. 3 is a sequential series of identical illuminated image shapes in multiple frame segments which may have plural optical fiber bundles defining a single frame segment. FIG. 3 is a series of sequential images creating the animated motion of a dolphin leaping out of water. The animated motion frame 300 is comprised of five (5) frame segments, each having the outline of the dolphin or the splash illuminated from a group of ends of optical fibers which are bundled together for illumination by a plurality of light sources.

The first frame segment has plural bundles of optical fibers for illuminating a portion of the outline of the dolphin and the splash. The partial outline of the dolphin is illuminated by a fiber optic bundle 302-1 and the splash is illuminated by a fiber optic bundle 304-1. For the first frame segment, and in order to differentiate visually between the outline image of the dolphin and the outline image of the splash, either a different light intensity or different color can be utilized for the fiber optic bundles 302-1 and 304-1.

The next three sequential frame segments of the image 300 showing only the dolphin 302-2, 302-3 and 302-4 are each separate illuminated images of the dolphin at various points in its leap, i.e. full extension out of the water, at the apogee of the leap, and diving back into the water. The final frame segment shows the dolphin entering the water with a splash. The partial image of the dolphin entering the water is illuminated by fiber optic bundle 302-5 and the splash being defined and illuminated by fiber optic bundle 304-5. As in the case of the first frame segment, either a different light intensity or different color may be utilized to differentiate between the partial image of the dolphin and the image of the splash in the fifth frame segment.

To simulate motion or to produce the desired animation, the frame segments are sequentially illuminated as follows. Both of the fiber optic bundles 302-1 and 304-1 are simultaneously illuminated to show the dolphin beginning its leap out of the water with the initial splash. Simultaneously with removing the light source from fiber optic bundles 302-1 and 304-1 after a timed period, the second frame segment of the dolphin is illuminated utilizing fiber optic bundle 302-2. After a similar timed period, the light source for fiber optic bundle 302-2 is removed and the third frame segment is illuminated utilizing fiber optic bundle 302-3. As in the earlier sequencing, after a timed period, the light source is removed from fiber optic bundle 302-3 and the fourth frame segment is illuminated utilizing fiber optic bundle 302-4. Finally, after a similar timed period, the light source is removed from the fiber optic bundle 302-4 and the plural fiber optic bundles 302-5 and 304-5 are illuminated to show the fifth and final frame segment of the animated motion of the dolphin diving back into the water ending the animated motion sequence. Thus, in a single frame depicting sequential motion of an image utilizing outline illumination, one can produce the desired animated motion by sequencing a combination of light intensities or colors within that single frame image in combination with single color outline illumination to depict the desired motion. This technique is useful to define multiple colors and light intensity per frame in animated motion.

Another type of animated motion can be classified as "back and forth" sequential animation. This is easily described by utilizing plural frame segment images to depict a bird in flight as shown in the single frame image 400 of FIG. 4. Although this sequential animation has been characterized as "back and forth" animation, such can also be classified as "forward and reverse" sequential animation. In a manner similar to the sequential forward animation described above, in this case the sequential pattern is reversed so that the ultimate motion perceived is that of a repetitive directional reversing motion. In further description, reference can be had to FIGS. 4A–4D.

FIGS. 4A–4D show each of four frame segments which, when properly overlaid and sequenced, show a bird in flight. The slight v-shape at the center of the group of illumination points is representative of the display ends of optical fibers is and shows the body of the bird. Because of the overlaying of each of the frame segments within a single space, the human eye perceives a larger body for the bird then what is provided for in each of the illuminated frame segments.

FIG. 4A shows a first group of illuminated points representing the display ends of optical fibers 402 which comprises the first frame segment showing the bird's wings in the extreme downward position. FIG. 4B depicts the bird with its wings extended horizontally from its body as shown by a group of illuminated points representative of the display ends of optical fibers 404 comprising the second frame segment. FIG. 4C shows the bird with its wings slightly raised above the horizontal represented by a group of illuminated points representing the display ends of optical fibers 406 comprising the third frame segment. FIG. 4D shows the bird with its wings in the extreme uppermost position as depicted by a group of illuminated points representative of the display ends of optical fibers 408 comprising the fourth frame segment.

The perceived motion occurs as each of the fiber optic bundles is illuminated by energizing a light source in close proximity to a first end of each optical fiber within the bundle. It should be noted that the second or display end of each optical fiber comprises the group of illuminated points 402, 404, 406 and 408.

The first frame segment is illuminated when the optical fiber bundle 410 has a light source presented to its first end illuminating the group of points showing the wings of the lowermost point of the flapping motion. After a timed period, the light source is removed from the optical fiber bundle 410 and a light source is applied to the first end of optical fiber bundle 412 illuminating the group of points showing the first upward flapping motion of the bird. After a second, similar timed period, the light source is removed from the first end of optical fiber bundle 412 and a light source is applied to the first end of optical fiber bundle 414 so that the group of illuminated points 406 is illuminated showing a continuing upward motion of the flapping of the bird's wings. Again, after a similar timed period, the light source is removed from the optical fiber bundle 414 and a light source is applied to the first end of optical fiber bundle 416 illuminating the points in the group 408 which shows the extreme upward motion of the bird's wings in its flapping motion. See FIGS. 4A–4D.

At this point, the bird's wings have moved upward from their lowermost position to their uppermost position. Now begins the directional reversal of the sequence from its forward motion to its backward motion. After another similar timed period, the light source is removed from the first end of optical fiber bundle 416 and a light source is reapplied to the first end of optical fiber bundle 414 (FIG. 4C) to show the first of the downward flapping motion of the bird's wings. After a similar timed period, the light source is removed from the first end of optical fiber bundle 414 and a light source is reapplied to the first end of optical fiber bundle 412 showing a continuing downward flapping motion of the bird's wings. The final frame segment of the animated motion of the single frame is the removal of the light source from the first end of fiber optical bundle 412 after a similar timed period and the reapplying of a light source to the first end of optical fiber bundle 410 to finish the downward flapping motion of the bird. Thus, for the animated motion of the birdlike image 400 of FIG. 4, the overlaid frame segments, as sequentially illuminated through seven (7) separate frame segments, produces the "back and forth" or "forward and reverse" repetitive directional reversing animated motion which may be perceived as a bird flapping its wings in flight. This technique is useful in defining the motion of bouncing balls, metronomes, pendulums and the like.

The next animation technique produces a desired type of animated motion utilizing plural images in a single frame. FIG. 5 depicts a bird in flight flapping its wings in conjunction with a palm tree swaying in the breeze. The perceived motion is unified and repetitive and utilizes the "back and forth" or "forward and reverse" sequential animation for repetitive directional reversing motion discussed above. With reference to FIG. 5, the single frame image 500 is shown with the combination of a bird in flight 502 and a swaying palm tree 504. The combined images of the bird in flight 502 and swaying palm tree 504 have three states which may be considered three separate, but sequential, frame segments through which the images move in a unified motion. As in the case of FIG. 4, the image of the bird in flight 502 has each of its three frame segments overlaying one another such that the body of the bird is depicted by the small v-shaped segment at the center of the groups of illuminated points which do not exactly overlie each other. This slight displacement creates the optical illusion of a slightly larger bird body then can be defined by a single optical fiber end. The combined unified motion is described below with reference to FIGS. 5A–5C.

In the first segment of the unified motion, the bird 502 is shown with its wings at their uppermost extension with a group of illuminated points representing the ends of optical fibers 502-1. Likewise, the palm tree is shown in its leftmost leaning position depicted by a group of illuminated points representative of the ends of optical fibers 504-1. Both of the groups of optical fibers 502-1 and 504-1 are joined into a first optical fiber bundle 506 for the combined simultaneous illumination of both images.

The second frame segment is shown in FIG. 5B. In this case, the image of the bird in flight is depicted by a group of illumination points representative of the ends of optical fibers 502-2, which show the bird's wings in a substantially horizontal position. The palm tree in this second frame segment is shown by a group of illuminated points representing the ends of optical fibers 504-2, which depict the palm tree as standing upright. Both groups of optical fibers 502-2 and 504-2 are combined into a second optical fiber bundle 508 for illumination.

The third frame segment is shown in FIG. 5C where the image of the bird in flight is depicted by a group of illumination points representative of the ends of optical fibers 502-3, which show the bird's wings in their lowermost position. The palm tree is depicted by a group of illuminated points representative of the ends of optical fibers 504-3, which depict the tree leaning toward the right. Both of the groups of the optical fibers 502-3 and 504-3 are combined into a third optical fiber bundle 510.

The unified motion of the plural images is accomplished through the sequential illumination of the first through third frame segments described above in connection with FIGS. 5A–5C. The sequence of illumination is to apply a light source to fiber optic bundle 506 to illuminate the first frame segment comprising the bird and palm tree shown by the groups of optical fiber display ends 502-1 and 504-1. After a timed period, the light source is removed from optical fiber bundle 506 and a light source is applied to optical fiber bundle 508 which produces the first motion of both the bird and palm tree as depicted by the groups of display ends of the optic fibers 502-2 and 504-2. Next, after a similar timed period, the light source is removed from the fiber optic bundle 508 and applied to fiber optic bundle 510 illuminating the third frame segment and the groups of display ends of optical fibers 502-3 and 504-3 showing the next sequential motion of the bird and palm tree.

As described above in connection with FIGS. 4A–4D, the directional motion is now reversed by removing the light source from the fiber optic bundle 510 and reapplying the light source to fiber optic bundle 508. Continuing with the directional reversal of the motion, the light source is removed from the fiber optic bundle 508 and reapplied to fiber optic bundle 506 completing the directional reversal of the motion. Thus, the complete forward and reverse unified animated motion of the bird in flight 502 and swaying palm tree 504 comprise five (5) frame segments such that the fiber optic bundles 506, 508, 510 and then 508 and 506 are illuminated and have their respective light sources removed in timed sequence producing the desired animated motion in a unified, combined animation of the bird in flight and palm tree swaying in the breeze. Thus, it is shown in the example how the present invention is able to define more than one animated image for each fiber optic bundle such as rain and fountains, erupting volcanoes with stars twinkling, and the like.

Figure 6:
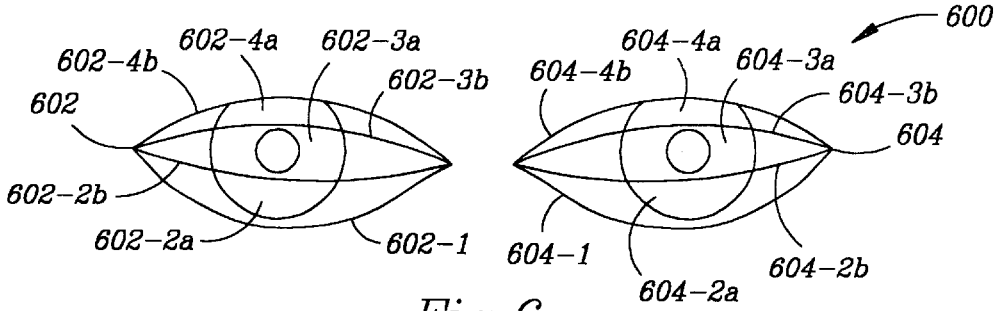
FIG. 6 is a single frame multiple segment multi-color forward and reverse sequential frame chase animation depicting a pair of blinking eyes.

With reference to FIG. 6, there is shown an example of animated motion incorporating multi-colored illumination in a "forward and reverse" sequential animation. The plural image single frame image utilizes another technique for creating animated motion using lighted images. In this case the plural images within the single frame are imparted unified motion with the use multiple colors to define the moving and stationary portions of the image. FIG. 6 depicts a combined image of a pair of eyes 600 which have a unified "blinking" motion. Each eye 602, 604 can either follow the other in a unified motion or blink in an independent motion with the other eye remaining stationary in any position from open to closed. Color is used to differentiate between the iris of the eye which remains stationary and the lid of the eye which has motion imparted to it by the changing arrays of illuminated points representing the groupings of optic fiber display ends.

Figure 6A:
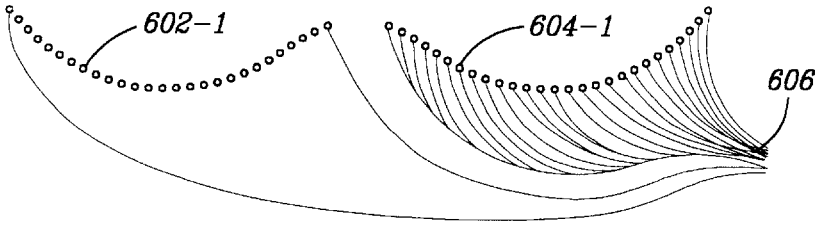
FIGS. 6A–6D depict each of four separate frame segments which sequence the eyes beginning in the closed position, then fully opening, which are overlaid to form the animated motion of FIG. 6.
Figure 6B:
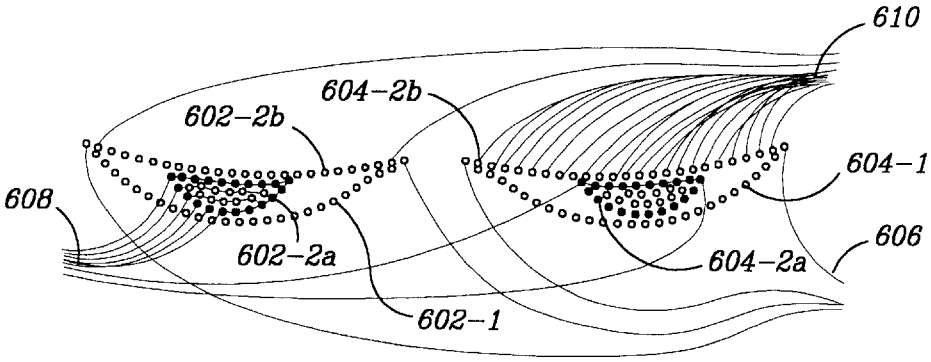

FIGS. 6 and 6A–6D depict a forward and reverse repetitive directional reversing motion utilizing multiple colors to impart the perceived motion and to assist in the differentiation of image parts. In FIG. 6A, the closed lids of the eyes are represented by the groups of illuminated points of the display ends of the optic fibers 602-1, 604-1 which optic fibers are combined in a first fiber optic bundle 606 for illumination. In FIG. 6B the groups of optic fibers 602-1 and 604-1 represent the bottom lid of each eye and a second set of groups of illuminated points of the display ends of the optic fibers 602-2*a*, 604-2*a* representing the partial iris of each eye are combined in a second fiber optic bundle 608 for illumination. Also in FIG. 6B a third set of groups of illuminated points of the display ends of optic fibers 602-2*b*, 604-2*b* representing the upper lid of each eye are combined in a third fiber optic bundle 610 for illumination.

Figure 6C:
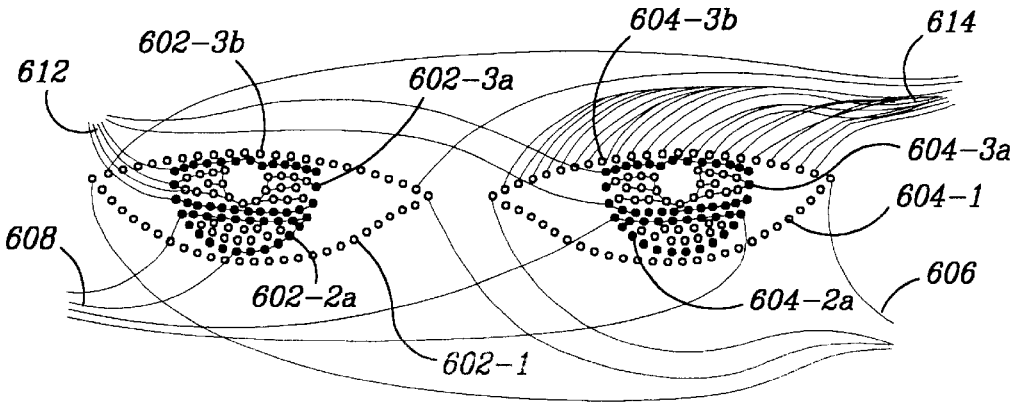

In FIG. 6C a fourth set of groups of illuminated points of the display ends of the optic fibers 602-3*a*, 604-3*a* representing a first expanded showing of the iris of each eye are combined in a fourth fiber optic bundle 612 for illumination. Also in FIG. 6C a fifth set of groups of illuminated points of the display ends of the optic fibers 602-3*b*, 604-3*b* representing the upper lid of each eye are combined in a fifth fiber optic bundle 614 for illumination.

Figure 6D:
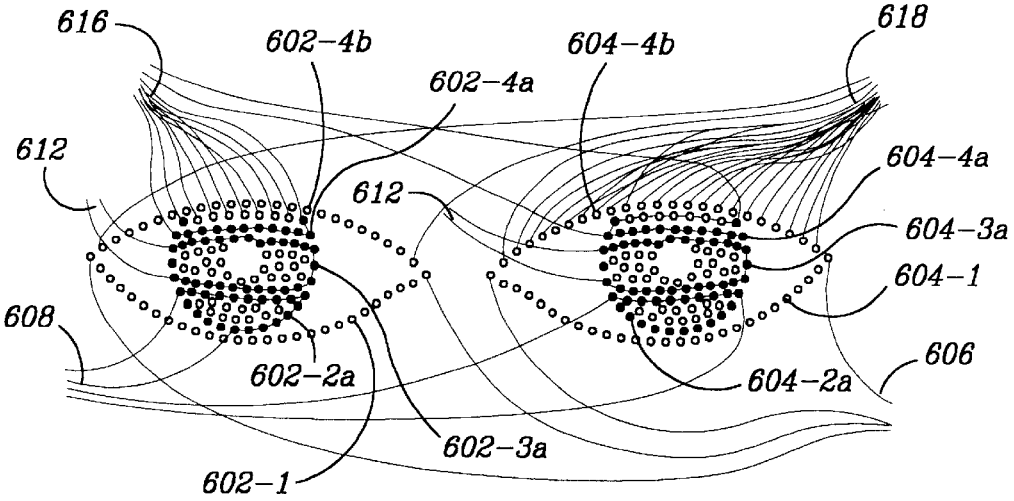

In FIG. 6D a sixth set of groups of illuminated points of the display ends of the optic fibers 602-4*a*, 604-4*a* representing a second expanded showing of the iris of each eye are combined in a sixth fiber optic bundle 616 for illumination. Also in FIG. 6D a seventh set of groups of illuminated points of the display ends of the optic fibers 602-4*b*, 604-4*b* representing the upper lid of each eye are combined in a seventh fiber optic bundle 618 for illumination.

With reference to FIGS. 6 and 6A–6D, the forward and reverse repetitive directional motion may be accomplished as follows. The fiber optic bundle 606 is illuminated for a timed period illuminating the closed eye lids of the eyes 602, 604. At the conclusion of the timed period, fiber optic bundle 606 remains illuminated for a second timed period and fiber optic bundles 608 and 610 are illuminated producing the motion of the eyes 602, 604 partially opening. During the second timed period, with the eyes opened farther, a part of the iris of each eye and the upper lid are illuminated in addition to continuing to illuminate the lower lid.

At the conclusion of the second timed period, fiber optic bundles 606 and 608 remain illuminated, the light source is removed from fiber optic bundle 610, and fiber optic bundles 612 and 614 are illuminated producing the motion of the eyes 602, 604 opening farther, an additional part of the iris and a different upper lid of each eye are illuminated in addition to continuing to illuminate the lower lid and the first part of the iris of each eye for a third time period. At the conclusion of the third timed period, fiber optic bundles 606, 608 and 612 remain illuminated, the light source is removed from fiber optic bundle 614, and fiber optic bundles 616 and 618 are illuminated producing the motion of the eyes 602, 604 opening to their farthest extent. During the fourth timed period an additional part of the iris and a different upper lid of each eye are illuminated in addition to continuing to illuminate the lower lid and both parts of the iris of each eye previously illuminated.

With each FIGS. 6A–6D corresponding to the first through fourth frame segments of the animated motion of the blinking eyes, the sequence of motion is as follows. In the first frame segment the lower lid of each eye 602-1, 604-1 is illuminated. In the second frame segment the lower lid of each eye 602-1, 604-1 remains illuminated, a first part of the iris of each eye 602-2*a*, 604-2*a* and a first upper lid of each eye 602-2*b*, 604-2*b* are illuminated. In the third frame segment the lower lid of each eye 602-1, 604-1 and a first part of the iris of each eye 602-2*a*, 604-2*a* remain illuminated while a second part of the iris of each eye 602-3*a*, 604-3*a* and a second upper lid of each eye 602-3*b*, 604-3*b* are illuminated. In the fourth frame segment the lower lid of each eye 602-1, 604-1, a first part of the iris of each eye 602-2*a*, 604-2*a* and a second part of the iris of each eye 602-3*a*, 604-3*a* remain illuminated while a third part of the iris of each eye 602-4*a*, 604-4*a* and a third upper lid of each eye 602-4*b*, 604-4*b* are illuminated.

In order to create the sequencing for the desired animated motion producing the blinking eyes 602, 604 with a full forward and reverse repetitive motion, seven steps are required with the stepping through the first through fourth frame segments to open the eyes followed by the third through the first frame segments to return the eyes 602, 604 to the closed position. The motion described is utilized in expanding or contracting an image, e.g. growing or shrinking, or in increasing or decreasing the density of an image.

Figure 7:
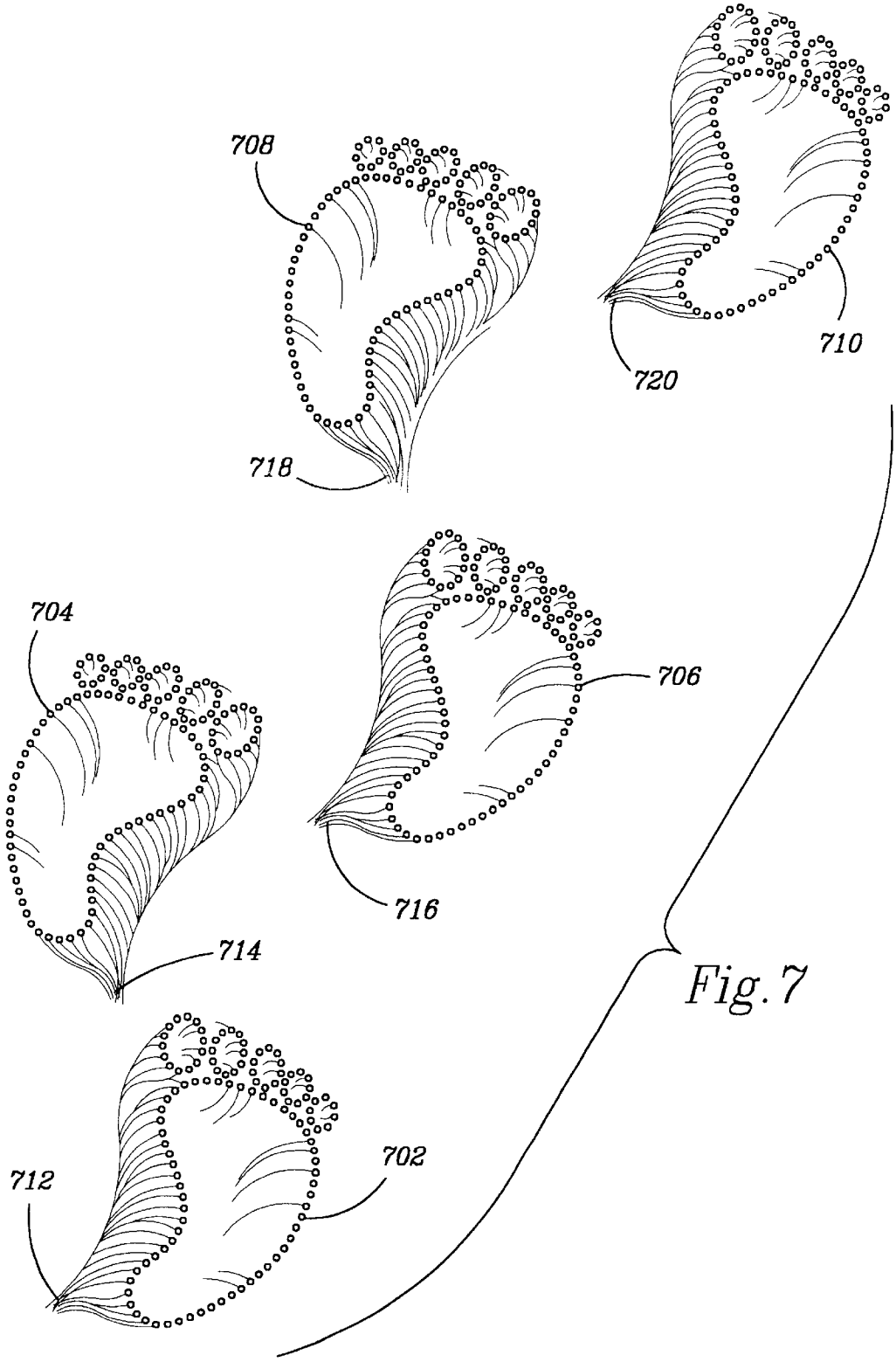
FIG. 7 is a single frame with multiple segments depicting forward and reverse frame chase animation in the form of a series of footprints.

Another animated motion produced by the appropriate timing and sequencing of groups of illuminated points is the series of footprints 700 of FIG. 7 depicting a multiple frame segment chase sequence. In this case the motion is achieved by illuminating different segments of the single frame image, i.e. separate images of the combined image, in a predetermined sequence to produce the desired animated motion. Each of the footprints is defined by a group of illuminated points arrayed about the outline of the footprint representing the second or display ends of optical fibers 702, 704, 706, 708 and 710. Each of the footprints has an associated fiber optic bundle 712, 714, 716, 718 and 720. To illuminate any of the footprints 702–710, a light source is positioned proximate to a first end of the fiber optic bundles 712–720.

To produce the desired forward chase motion the first footprint 702 is illuminated through fiber optic bundle 712 with a first light source for a first timed period. While the first footprint 702 remains illuminated, the second footprint 704 is illuminated through fiber optic bundle 714 with a second light source for a second timed period partially overlapping the first timed period. At the end of the first timed period the first light source is removed from the first footprint 702, the second footprint 704 remains illuminated and a third footprint 706 is illuminated through fiber optic bundle 716 with a third light source for a third timed period partially overlapping the second timed period. At the end of the second timed period the second light source is removed from the second footprint 704, the third footprint 706 remains illuminated and a fourth footprint 708 is illuminated through a fourth fiber optic bundle 718 for a fourth timed period partially overlapping the third timed period. At the end of the third timed period the third light source is removed from the third footprint 706, the fourth footprint 708 remains illuminated and a fifth footprint 710 is illuminated through a fifth fiber optic bundle 720 for a fifth timed period partially overlapping the fourth timed period. In the animated motion depicted in FIG. 7 with the described illumination timing the fourth and fifth footprints 708, 710 remain illuminated in the fifth time period.

The forward chase sequence animation can continue as described indefinitely. However, variations can be introduced such as intermittent directional reversals with backtracking of footprints, timing delays indicative of pauses in progress, or the partial lifting of a foot depicted by the partial removal of the light source from the rear portion of a footprint. This animated motion technique is useful in depicting movement across an expanse in a particular direction such as a flow of lava, moving water in a river, moving traffic along a roadway, and the like.

FIG. 8 illustrates a "marquis effect" by creating a random flashing of groups of illuminated points in a defined area representing a particular image, e.g. an alphanumeric character, shape or design. A series of two of more fiber optic bundles with individual ends of the optical fibers may be arrayed randomly, dispersed in equal density, or dispersed in a particular location within the outline of the image to create the intended motion. The marquis image 800 may be comprised of one of more characters. For the character "O" 802 there are shown three groupings of illuminated points representing the display ends of optical fibers 804, 806 and 808. Each of the groupings represent a series of randomly dispersed ends of optical fibers associated with three fiber optic bundles 810, 812 and 814. When the first, second and third fiber optic bundles 810, 812 and 814 are sequentially illuminated for short timed periods, i.e. rapidly turned on and then off in repeated sequence, a random flashing occurs across the expanse of the internal area of the character.

Similarly, for the letter character "W" 816, there are shown three groupings of illuminated points representing the ends of optical fibers 818, 820 and 822. Each of the groupings represent a series of randomly dispersed ends of optical fibers associated with three fiber optic bundles 824, 826 and 828. When the first, second and third fiber optic bundles 824, 826 and 828 are sequentially illuminated for short timed periods, i.e. rapidly turned on and then off in repeated sequence, a random flashing occurs across the expanse of the internal area of the character. With both of the characters 802, 816 arranged in the same "marquis", the random flash lighting of the characters creates a starburst-like motion across each character, and across the entire array of characters with more than one in the array. With plural characters, the fiber optic bundles may utilize common light sources to achieve the intended animated motion. This technique uniquely defines a starry sky, a large number of lightning bugs, etc.

FIG. 9 is a diagrammatic representation of the modularized control for use with the present invention. The animated motion control system 900 is comprised of a source of electrical energy 902, which may be a battery pack or similar portable energy source having an extended operating time. The battery pack 902 is connected to both the timing and sequencing control means 904 and to a series of separate light sources 906-1 through 906-8. The number of separate light sources is exemplary only and should not be construed as limiting or restricting the number of fiber optic bundles which may be illuminated by the control means 904. The light sources 906 may be light emitting diodes or any other low voltage light source now known or later discovered, and may include colored light emitting diodes or colored lenses placed over the light emitting diodes to produce the desired colors.

Connected proximate to each of the separate light sources 906-1 through 906-8 are corresponding fiber optic bundles

908-1 through 908-8. Each of the fiber optic bundles contains the first ends of optical fibers grouped together for illuminating a portion of an image as described in this disclosure. The illumination may be of portions of combined images or segments of images, and remain illuminated in accordance with the timing and sequence mandated by control means 904.

The control means 904 may be comprised of an integrated circuit with on-board memory and multiple timing means for independently controlling each of the light sources 906. The memory may contain predetermined illumination sequences and related timed periods for use in controlling the plural light sources 906. A single control means 904 may be utilized to supply the timing and sequence of illumination to a plurality of images simultaneously, or a plurality of control means 904 may be used to independently control a corresponding number of images. In either instance, the control means 904 will control the exact timing and sequence of illumination of any of the described animated motions attributable to the images depicted in FIGS. 1–8, and in FIG. 10 to be described below.

With reference to FIG. 10. the animated motion depicted is that of a fluid being poured from a bottle into a receptacle. This motion utilizes a combination of several of the techniques described above within a single frame. These animated motion sequences include the repositioning of the bottle, which is a forward chase sequence animation, the pouring of the fluid from the bottle with a second repositioning, which is a combination of a contracting image and a second forward chase sequence, the fluid being poured from the bottle to the receptacle, which is a combination of positioning, growth or expansion of the fluid flow, and the sparkling "marquee" effect, and the growth of the collecting fluid in the receptacle, which is an image expansion within a confined space. All of these combine to form the combined animated image and produce the animated motion within a single frame.

The single frame image of the bottle pouring the fluid into the receptacle 1000 is shown in FIG. 10. FIGS. 10A–10D depict the several frame segments which comprise the animated motion of the complete image 1000 of FIG. 10. In the several figures, common base reference numbers will be used for the bottle 1002, the fluid in the bottle 1004, the fluid pouring from the bottle 1006, the receptacle or glass 1008 and the fluid level in the glass 1010. Each of these designations will be characterized with frame segment denominators with the first frame segment shown in FIG. 10A, the second frame segment shown in FIG. 10B, the third frame segment shown in FIG. 10C and the fourth frame segment (with the following animated motion regarding the fluid) shown in FIG. 10D.

Figure 10C:
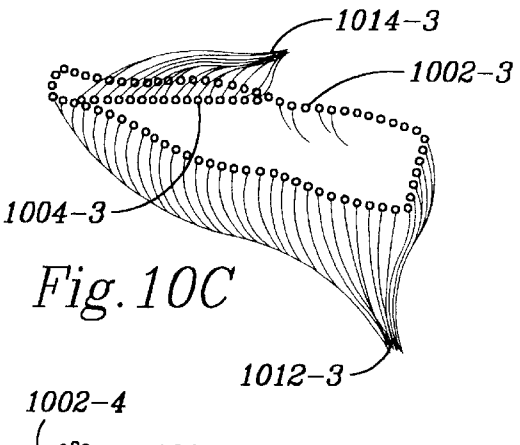
FIGS. 10A–10D depict each of four separate illumination sequences of a bottle containing a fluid which is poured into a receptacle, with the fluid in the state of being poured.
Figure 10B:
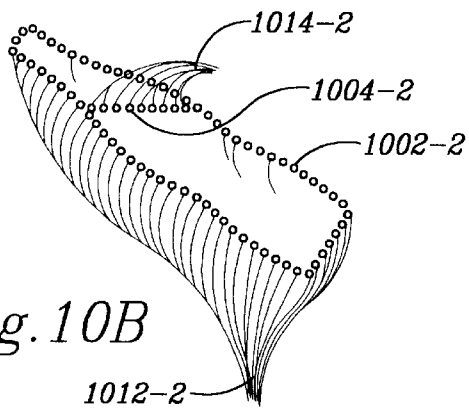
Figure 10A:
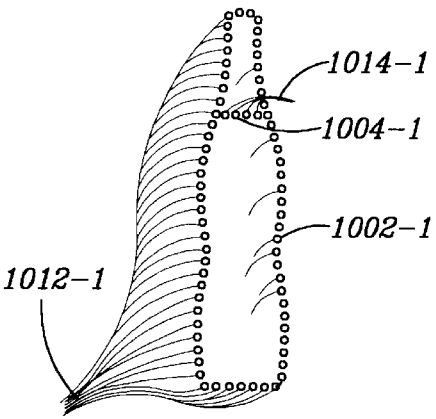

In FIG. 10A, the bottle 1002 is represented by the group of illuminated points at the display ends of the optical fibers 1002-1 which optic fibers are combined in a first fiber optical bundle 1012-1 for illumination. The level of the fluid in the bottle is represented by the group of illuminated points of the display ends of the optical fibers 1004-1 which optic fibers are combined in a second fiber optical bundle 1014-1 for illumination. As this is a static frame segment, both fiber optic bundles 1012-1 and 1014-1 will be illuminated simultaneously.

In FIG. 10B, the bottle is represented by the group of illuminated points at the display ends of the optical fibers 1002-2 which optical fibers are combined in a third fiber optic bundle 1012-2. The fluid level, since the bottle is now slightly raised and tilted forward, is represented by the group of illuminated points of the display ends of the optical fibers 1004-2 which optical fibers are combined in a fourth fiber optic bundle 1014-2 for illumination. This second frame segment is also static and the fiber optic bundles 1012-2 and 1014-2 are illuminated simultaneously. This illumination which immediately follows the removal of the light source from the fiber optic bundles 1012-1 and 1014-1 shown in FIG. 10A, produce a forward chase sequence animated motion for the bottle and the fluid showing the bottle rise, tilt forward, with the fluid level following the motion.

In FIG. 10C, the bottle is represented by the group of illuminated points of the display ends of the optical fibers 1002-3 which optical fibers are combined in a fifth fiber optic bundle 1012-3 for illumination. The fluid level of the now further forward tilted bottle is represented by the group of illuminated points of the display ends of the optical fibers 1004-3 which optical fibers are combined in a sixth fiber optic bundle 1014-3 for illumination. As the frame segment shown in FIG. 10C is merely the next segment in the forward chase sequence animation of raising and tilting the bottle forward, both fiber optic bundles 1012-3 and 1014-3 are illuminated simultaneously. In each of the first three frame segments, the fiber optic bundles depicting the bottle and the fluid level may have the same light source, separate light sources of the same color or separate light sources of different colors.

Figure 10D:
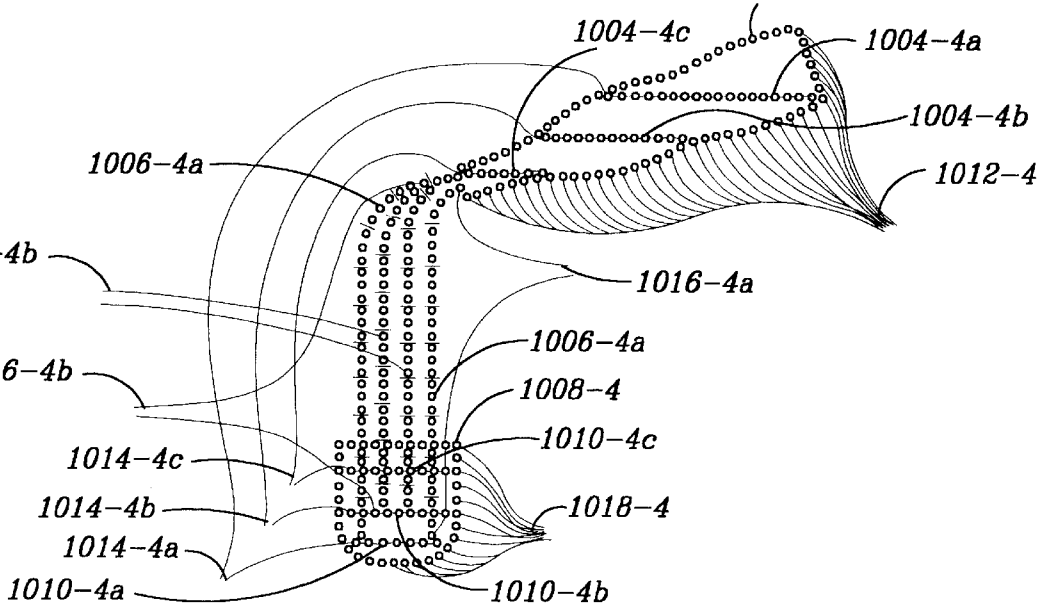

FIG. 10D is the final frame segment of the forward chase sequence animation in which the bottle 1002 takes its final position slightly downward of horizontal with the outline of the bottle represented by the group of illuminated points of the display ends of the optical fibers 1002-4 which optical fibers are combined in a seventh fiber optic bundle 1012-4. When the bottle assumes this position, the receptacle or glass 1010 appears for the first time in the frame segment and is represented by the group of illuminated points of the display ends of the optical fibers 1008-4 which optical fibers are combined in an eighth fiber optic bundle 1018-4 for illumination. At the same time, a first fluid level in the bottle is represented by the group of illuminated points of the display ends of the optical fibers 1004-4*a*. The first fluid level in the glass 1008 is represented by the group of illuminated points of the display ends of the optical fibers 1010-4*a*. The optical fibers 1004-4*a* and 1010-4*a* are combined in a ninth fiber optic bundle 1014-4*a* for illumination.

Also in FIG. 10D in the fourth frame segment, there appears for the first time the liquid pouring from the bottle 1002 into the glass 1008. The pouring liquid 1006 is represented by a first group of illuminated points of the display ends of the optical fibers 1006-4*a*. The optical fibers 1006-4*a* are segregated into three sub-groupings of a single line chase sequence (as described with reference to FIGS. 1 and 1A–1D) to define the pouring liquid 1006 with motion from the bottle 1002 to the glass 1008. The continuous illumination of each of the sub-groupings of the optical fibers 1006-4*a* produces a continuous linear sequence animation depicting the liquid 1006 pouring from the bottle 1002 into the glass 1008. The optical fibers 1006-4*a* are combined in a tenth fiber optic bundle 1016-4*a* for illumination. The pouring fluid is also represented by a second group of illuminated points of the display ends of the optical fibers 1006-4*b*, which are also segmented into sub-groups as described above in connection with optical fibers 1006-4*a* to achieve the animated motion of a pouring liquid. The optical fibers 1006-4*b* are combined in an eleventh fiber optic bundle 1016-4*b* for illumination. The optical fibers 1006-4*a* are the outer pour lines of the liquid 1006 and the optical fiber 1006-4*b* are the inner pour lines of the fluid 1006.

The second level of the liquid in both the bottle and in the glass is represented by the groups of illuminated points of the display ends of the optical fibers 1004-4*b* and 1010-4*b*, respectively. The optical fibers 1004-4*b* and 1010-4*b* are combined in a twelfth fiber optic bundle 1014-4*b* for illumination. The third fluid levels in both the bottle and the glass receptacle are represented by the groups of illuminated points of the display ends of the optical fibers 1004-4*c* and 1010-4*c*, respectively. The optical fibers 1004-4*c* and 1010-4*c* are combined in a thirteenth fiber optic bundle 1014-4*c* for illumination.

The particular sequence for the animation can be described as follows. However for the sake of clarity, it is to be understood that the sequential timed periods are all of equal duration. In the first frame segment, as shown in FIG. 10A, the fiber optic bundles 1012-1 and 1014-1 are illuminated to depict the outline of the bottle 1002 and the level of the fluid 1004 in the bottle. After the first timed period, the light source is removed from fiber optic bundles 1012-1 and 1014-1 and the fiber optic bundles 1012-2 and 1014-2 are illuminated showing the bottle slightly raised and tilted forward at approximately a 45° angle as shown in FIG. 10B. After the second time period, the light source is removed from the fiber optic bundles 1012-2 and 1014-2 and the fiber optic bundles 1012-3 and 1014-3 are illuminated to produce the orientation of the bottle 1002 and fluid level 1004 as shown in FIG. 10C. During the third timed period, the bottle 1002 is tilted farther forward to almost a horizontal position and the fluid 1004 moves closer to the bottle opening.

After the third timed period, the light source is removed from the fiber optic bundles 1012-3 and 1014-3 and fiber optic bundles 1012-4 (bottle), 1018-4 (receptacle), 1014-4*a* (fluid level in bottle and receptacle) and 1016-4*a*, 1016-4*b* (pouring liquid) are illuminated. During the fourth timed period, the bottle is oriented with its opening slightly below horizontal with the liquid level in the bottle is presented as diminishing, the liquid is shown as being poured and the fluid level in the receptacle is shown as increasing or expanding to the first fluid level in the glass 1010-4*a*.

After the fourth timed period, the light source is removed from fiber optic bundles 1014-4*a* and 1016-4*a* with the fiber optic bundles 1012-4, 1018-4 and 1018-4*b* remaining illuminated. Also, fiber optic bundle 1014-4*b* is illuminated depicting the changed fluid levels in the bottle 1002 and the glass 1008 at their second levels and reducing the pouring liquid from a wide stream to a narrower stream, but continuing the linear chase sequence of the sub-groupings of optic fibers 1006-4*b* to show the downward motion of the liquid.

After the fifth timed period, fiber optic bundles 1012-4, 1018-4 and 1016-4*b* remain illuminated and the light source is removed from fiber optic bundle 1014-4*b*. Fiber optic bundle 1014-4*c* is now illuminated to show the changed fluid level at its significantly contracted state in the bottle 1002 and significantly expanded state in the glass 1008. The linear chase sequence of the sub-groupings of the optic fibers 1006-4*b* continues to show the downward motion of the liquid from the bottle into the glass.

In order to create the sequencing for the desired combined animated motion producing the repositioning of the bottle and the pouring of the liquid into the glass with a full forward chase motion for the bottle and image contraction and expansion for the liquid with the semblance of a downward pouring motion, six steps are required with the first through third frame segments to move the bottle from its stationary, upright supported position to a position almost ready for pouring as shown in FIGS. 10A–10C. The actual pouring of the liquid from the bottle to the glass, which includes the final positioning of the bottle, the appearance of the glass, and the pouring motion in a downward direction of the liquid is shown in FIG. 10D and comprises three overlaid frame segments to complete the animated motion. Thus, the motion described utilizes a linear chase sequence comprised of multiple sub-frame images having multiple light sources and coloration, the bottle illuminated in one color and the fluid level illuminated in a second color. The motion also utilizes an expanding or contracting image, i.e. the shrinking or decreasing level of the liquid in the bottle and the expanding or increasing level of the liquid in the glass. The motion also utilizes a grouped linear sequence chase motion to depict the downward direction of the pouring liquid, which also is imparted a visual perception of speed and density by an intensified, wider flow at the outset which is narrowed to depict a slower flow at the conclusion of the pour. The pouring liquid and the fluid level in the glass are all illuminated in the same color as the liquid in the bottle. The outline of the glass may be illuminated in the same color as the bottle or in a third color. When combined and sequenced as described, both the forward chase, multiple sub-frame images of FIGS. 10A–10C and the overlaid sub-frame images of FIG. 10D combine to produce the desired animated illuminated motion. The method of incorporating several animation techniques described here is useful to define multi-colored three-dimensional figures moving across a surface or to create the illusion of objects coming out of the cloth.

Thus, it can be seen from the descriptions of the various animated illumination techniques to derive motion across a single frame by utilizing linear continuous segmented images, either separate or overlaid, repetitive directional reversing of such single images (or plural images having combined unified motion), rotational motion utilizing a plurality of sub-frame images, and the marquee or starburst random illumination to define instantaneous image positions produces the desired visual perception of the defined image motion within a single frame. Each of the described techniques which will produce differing animated motions can be utilized individually or be taken in selected combination to achieve the desired animated illuminated motion. Augmenting and making the motion easier to perceive is the use of different colors as well as the combination of the different techniques to achieve the desired animated illuminated motion.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

I claim:

1. A method for producing a continuous animated motion of combinations of two or more combined images within a defined area utilizing time sequenced color changing illumination patterns of groups of optical fibers comprising the steps of:

a. providing illumination to first ends of one or more groups of optical fibers being contained in a plurality of fiber optic bundles by a plurality of light sources arranged in juxtaposition against a corresponding number of said plurality of optic fiber bundles;

b. mounting second ends of said one or more groups of optical fibers to and through a planar surface in a plurality of pre-determined arrays forming a plurality of image segments;

c. illuminating said plurality of image segments forming two or more combined images across the defined area on said planar surface by receiving said illumination by said first ends of said one or more groups of optical fibers and transferring said illumination to said second ends of said optical fibers, the improvement characterized by the steps of:

d. accessing one or more memory devices of a controller to obtain pre-programmed illumination sequences, coloration and related timings for each of the plurality of image segments;

e. independently controlling each of said plurality of light sources for causing the illumination of said pre-determined arrays while simultaneously controlling, in time-overlapping synchronization, the changing illumination of said plurality of image segments of each of said two or more combined images in accordance with the pre-programmed illumination sequences, coloration and related timings permitting the illumination of said plurality of pre-determined patterns to form said image segments in a simultaneous synchronous progression of two or more of said plurality of image segments; and, f. combining each of said plurality of image segments in said defined area in said simultaneous synchronous progression thereby producing one or more animation techniques imparting continuous animated motion to the two or more combined images.

2. The method in accordance with claim 1, wherein the planar surface is selected from. the group consisting of flexible fabric material utilized in the construction of wearing apparel and flexible plastics, polymerics, cardboard and other paper materials utilized in the constructing substantially rigid display panels.

3. The method in accordance with claim 1, including the step of overlaying said plurality of image segments one upon another producing a rotational motion.

4. The method in accordance with claim 1, including the step of overlaying said plurality of image segments one upon another producing -a repetitive directional reversing motion.

5. The method in accordance with claim 1, wherein the one or more animation techniques are selected from the group consisting of successive linear progression, unified multi-image, overlaid directional reversing and random sparkling.

6. The method in accordance with claim 5, wherein the successive linear progression animation techniques are selected from the group consisting of image expansion, image contraction, segmented directional flow, direction reversing and forward/reverse chase.

7. The method in accordance with claim 1, including-the step of positioning said plurality of image segments one upon another for producing a segmented directional flow motion.

8. The method in accordance with claim 1, including the step of positioning said plurality of image segments one upon another for producing a forward/reverse chase motion.

9. The method in accordance with claim 1, including the step of positioning said plurality of image segments one upon another for producing a repetitive directional reversing motion.

* * * * *